United States Patent [19]

Mulder

[11] Patent Number: 4,543,274

[45] Date of Patent: Sep. 24, 1985

[54] POWDER SPRAY GUN AND POWDER SPRAY METHOD

[75] Inventor: Douglas C. Mulder, Wellington, Ohio

[73] Assignee: Nordson Corporation, Amherst, Ohio

[21] Appl. No.: 623,005

[22] Filed: Jun. 21, 1984

[51] Int. Cl.[4] ..... B05B 1/08

[52] U.S. Cl. ..... 427/197; 427/180; 427/421; 239/DIG. 3; 239/434.5; 118/308

[58] Field of Search ..... 239/DIG. 3, 434.5; 118/308; 427/180, 197, 421

[56] References Cited

U.S. PATENT DOCUMENTS

| | | | |
|---|---|---|---|
| 2,929,436 | 3/1960 | Hampshire | 118/308 X |
| 3,746,254 | 7/1973 | Duncan et al. | 239/15 |
| 4,212,266 | 7/1980 | Payne et al. | 118/308 X |
| 4,245,551 | 1/1981 | Berkmann | 55/273 |
| 4,277,260 | 7/1981 | Browning | 98/115 SB |
| 4,411,388 | 10/1983 | Mack | 239/434.5 |

OTHER PUBLICATIONS

Vortec Advertisement © "Transvector Air Flow Amplifier".

*Primary Examiner*—Shrive P. Beck
*Attorney, Agent, or Firm*—Wood, Herron & Evans

[57] ABSTRACT

A powder spray gun and method of spraying powder are disclosed wherein an air flow amplifier is contained within the gun and is operable to draw ambient air into the gun and to impact air entrained powder passing through the gun with a high velocity stream of compressed air so as to accelerate the velocity of powder emitted from the gun.

13 Claims, 4 Drawing Figures

POWDER SPRAY GUN AND POWDER SPRAY METHOD

This invention relates to the spraying of solid particulate powder material, and more particularly to an improved method and apparatus for spraying solid particulate powder material.

The need for the improved powder spray gun of this invention was discovered in connection with the application of powdered adhesives to webs of non-woven fibers. Traditionally, non-woven fabrics have been manufactured by spraying a liquid adhesive onto a wide web of loose fibers and then passing that liquid adhesive containing web of loose fibers through compression rollers so as to compress the web and adhesively secure the fibers to one another. Quite commonly, the webs of loose fibers are ¼ to ½ inch in thickness when the adhesive is applied and, after compression, are approximately 0.005 to 0.06 inch in thickness.

A very desirable characteristic of non-woven fabrics is that they have a soft fluffy feel as well as a high tensile strength. Generally though, the greater the tensile strength of the materials, the greater is the quantity of adhesive required to impart that tensile strength and the less is the softness or fluffiness of the resulting fabric. In other words, the softness or fluffiness of the non-woven fabric is inversely proportional to the quantity of liquid adhesive applied and the resulting tensile strength of the fabric. In part, this characteristic is attributable to the fact that in order to obtain good tensile strength of the fabric it is necessary to thoroughly penetrate the web of loose fibers with adhesive. Consequently, the web must be thoroughly wetted with a substantial quantity of adhesive in order to impart good tensile strength but in the process, the softness or fluffiness of the resulting fabric is impaired.

In an effort to obtain a soft or fluffy non-woven fabric with relatively high tensile strength, efforts have been made to substitute powdered adhesive for the liquid adhesive which has heretofore been traditionally used to bond the fibers of the non-woven fabric. One such attempt involved metering powdered adhesive through a slotted hopper in which the powder was distributed via a rotating auger. The resulting powder containing non-woven fiber web was then heated to melt the adhesive powder and passed through rollers to compress and adhere the web. In general, this slotted spreader was unsatisfactory for most applications because it did not evenly distribute the powder over the surface of the non-woven fiber mat and it was incapable of supplying very low quantities of powder evenly distributed over a large area. In many applications as little as 1–12 grams per square meter of powdered adhesive is required to be evenly distributed over the surface of the non-woven web fabric. Additionally, powder from this auger fed slotted spreader did not penetrate the web sufficiently to achieve good tensile strength in the resulting fabric when the powdered adhesive was subsequently melted and the web passed through compression rollers.

Another attempt at substituting powdered adhesive for the liquid adhesive heretofore utilized in bonding the fibers of a non-woven fabric involved application of the powder to the surface of a rotating roller from which the powder was dispersed by application of an electrical charge to the surface of the roller. The electrical charge on the roller repelled the powder so as to cause it to move off of the roller onto the surface of the non-woven fiber web passing beneath the roller. This approach was also found to be unsatisfactory because it did not result in an even distribution of relatively small quantities of powder over a large area, i.e., 1–12 grams of powder per square meter evenly distributed over the surface of the non-woven fiber web. Furthermore, the use of an electrical charge to disperse powder from a rotating roller did not impart sufficient velocity to the powder to cause the powder to adequately penetrate the web of non-woven fibers. As a result, the resulting non-woven fabric did not have the desired tensile strength.

In an effort to develop equipment capable of satisfactorily applying powdered adhesive to non-woven fiber webs, it was suggested that the powder be sprayed onto the web. But, the spraying of powdered adhesive onto the non-woven fiber web has required the development of new equipment for applying that powder because the only spray equipment heretofore available was incapable of applying an evenly distributed pattern of powdered adhesive over a wide web, or of obtaining sufficient penetration of the powder into the non-woven fiber web.

It has therefore been an objective of this invention to provide a new apparatus or powder spray gun for applying an evenly distributed pattern of powdered material to a wide web of loose non-woven fiber material while simultaneously obtaining substantial penetration of that web by the powder.

Powder spray guns are well known in the prior art but when conventional powder spray guns were initially employed for this application, it was found that the guns sprayed far too narrow a pattern and when multiple guns were utilized, the patterns sprayed by the guns tended to overlap and streak. As a result, there were hard spots in the resulting non-woven fabric. Additionally, the powder tended to lie on the top of the non-woven fiber web rather than to penetrate the web as is required in order to obtain a good tensile strength product. To that end it was another objective of this invention to provide a powder spray gun which would spray an evenly distributed wide pattern so as to enable a relatively wide web of base material to be evenly covered with adhesive and simultaneously impart sufficient velocity to the powder to obtain good powder penetration of the web.

The powder spray gun of this invention which overcomes both the distribution and the penetration problems described hereinabove utilizes an air amplifier at the input end of a powder spray gun. This amplifier is operative to impart a relatively high velocity to a stream of powder passing through the gun with the result that the powder adequately penetrates the web. Additionally, it was found that if such an air amplifier were utilized in combination with the gun, and if a large cone were placed adjacent the discharge end of the gun, the relatively high velocity powder emitted from the gun would be caused by the diverging surfaces of the cone to spread over a wide surface area while simultaneously obtaining an even distribution of relatively small quantities of powder over that wide area.

Another problem encountered was that the pattern of powder emitted from the gun tended to vary with time. Whereas, a pattern might start out satisfactorily distributed over the surface of the fiber web, over a long period of time, the pattern changed and began to streak. This problem was found to at least partially be attributable to the build-up of a tribocharge on the powder emitted from the gun. By utilizing a grounded metal, electrically conductive cone for dispersing the powder emitted from the gun, this build-up was avoided and the spray pattern remained consistent. Accordingly, in one preferred embodiment of the invention the complete powder spray gun utilized in the practice of this invention is manufactured from electrically conductive metal, and that metal is grounded.

The primary advantage of the invention of this application is that it enables a relatively small quantity of solid particulate powder material, as for example, 1–12 grams per square meter, to be applied in a wide evenly distributed pattern. This invention also has the advantage of maintaining a good pattern of sprayed material over a prolonged period of time because of the elimination or reduction of the tribocharge on the powder emitted from the gun.

This powder spray gun also has the advantage of imparting sufficient velocity to the powder emitted from a powder spray gun so that the powder will penetrate the target substrate or will penetrate air streams surrounding a target substrate moving at a high velocity through the powder spray booth within which the gun is contained. In a preferred embodiment, the target substrate moves at a speed of 300–600 feet per minute with the result that there are relatively strong air currents associated with that high speed moving substrate. In the absence of an air flow amplifier associated with the powder spray gun of this invention, the powder sprayed from the gun would not have sufficient velocity to penetrate these air currents or air streams with the result that the air streams would disturb and ultimately upset the even distribution of powder emitted from the gun.

These and other objects and advantages of this invention will be more readily apparent from the following description of the drawings in which.

Figure 1:
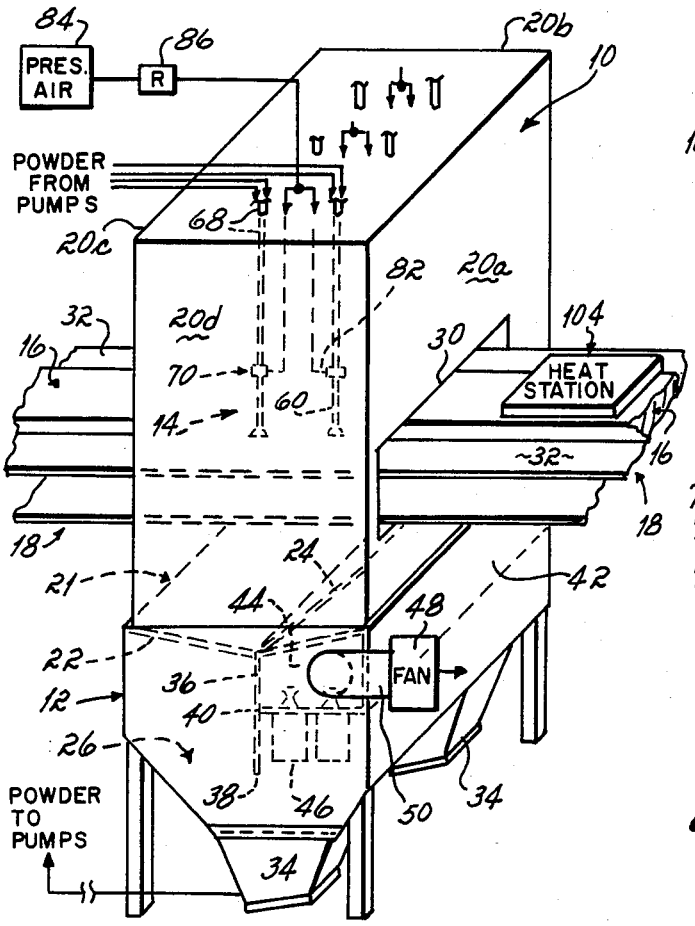
FIG. 1 is a perspective view of a powder spray booth incorporating the invention of this application.
Figure 2:
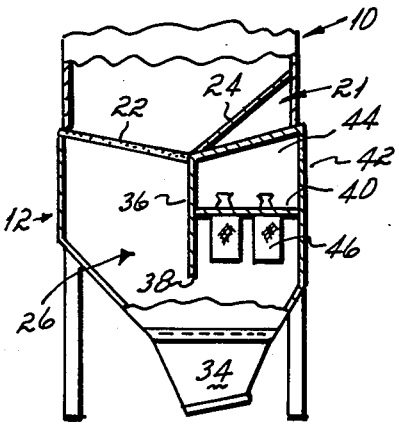
FIG. 2 is a cross sectional view through the lower portion of the booth illustrated in FIG. 1.

Referring first to FIGS. 1 and 2, it will be seen that the novel powder spray guns 14 of this application are embodied in a powder spray booth 10 having a powder recovery system 12 mounted on the underside thereof. Within the booth, solid particulate powder material is sprayed from the guns 14 onto the top of a web 16 of non-woven fabric material as that web passes through the booth upon the top of an endless conveyor 18. In a preferred embodiment, this conveyor is in the form of a continuous foraminous screen which transports the web through the booth at a velocity of 300–600 feet per minute.

The booth 10 comprises four side walls 20*a*, 290*b*, 20*c* and 20*d* and a bottom wall 21. The bottom wall 21 is divided into two sections 22, 24 which extend between opposite sides 20*b*, 20*d* of the booth. One section 24 is imperforate and slopes upwardly at an angle of approximately 30° from the center of the booth toward the side 20*a*. The other section 22 comprises a screen which extends between the sides 20*b*, 20*d* of the booth and which slopes upwardly at an angle of approximately 20° from the center of the booth toward the side 20*c*. Beneath the screen 22 is a powder recovery chamber 26 wherein oversprayed powder from the booth is collected after passing through the screen 22.

The conveyor 18 passes through openings 30 in opposed side walls 20*a*, 20*c* of this booth. These openings 30 are slightly larger in width than the width of the belt 32 of the conveyor 18 and extend vertically a distance slightly greater than the height of the conveyor. Consequently, there is an opening around the conveyor through which air may be pulled into the booth, as explained more fully hereinafter, to maintain oversprayed powder within the booth Oversprayed powder falls by gravity or is pulled by suction air flow from the interior of the booth 10 downwardly through and around the foraminous conveyor 18 through the screen 22, into the collection chamber 26. The collection chamber is divided into two sections by a vertical wall 36 which extends downwardly from the bottom wall of the booth 10. This wall terminates at a lower edge 38 spaced above the top of the collection hoppers 34. Additionally, there is a horizontal wall 40 which extends between the vertical wall 36 and a vertical outside wall 42 of the collection chamber. This horizontal wall 40 in conjunction with the vertical wall 36, the side wall 42 of the collection chamber, and bottom wall 24 of the booth define a clean air chamber 44. There are openings in the horizontal wall 40 over which filters or filter cartridges 46 are mounted. A vacuum fan 48 is connected to the clean air chamber 44 via a conduit 50. The fan 48 is operable to pull air from the booth 10 downwardly through the conveyor 18, through the screens 22, and into the powder collection chamber 26. This air stream is pulled beneath the lower edge 38 of the vertical wall 36, upwardly through the filters 46, through the openings in the horizontal wall 40, into the clean air chamber 44 and subsequently through the conduit 50 to the fan 48. This air flow pulls oversprayed powder from the booth downwardly into the collection chamber where the majority of powder falls by gravity into the collection hoppers 34. The lightest powder collects on the outer periphery of the filter cartridges from which it is periodically dislodged by a short burst of reverse air flow as is now conventional in this art.

Powder collected in the collection hoppers 34 is generally pumped by venturi pumps (not shown) from the collection hopper to feed hoppers for recirculation to the guns 14. If the powder is contaminated by too much fiber from the fiber web 16, then the oversprayed powder 34 cannot be directly recirculated to the feed hoppers but must first be collected and purged of the contaminants from the fiber web 16 before being recycled.

In the illustrated embodiment of the booth 10, there are six powder spray guns contained within the booth 10. The number of guns through is a function of the width of the web 16 as well as the quantity of powder to be applied thereto.

Figure 4:
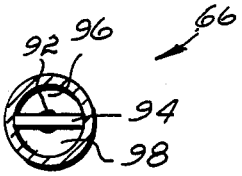
FIG. 4 is a cross sectional view taken on line 4—4 of FIG. 3.
Figure 3:
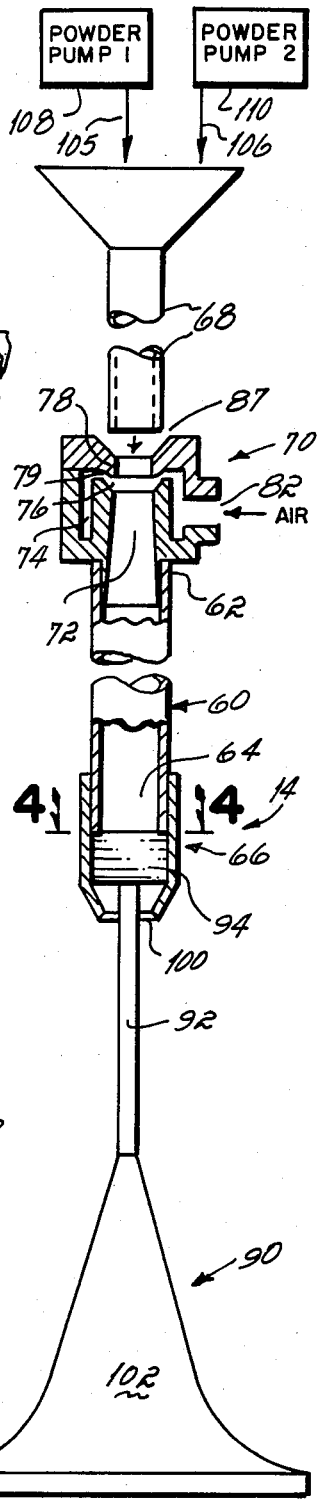
FIG. 3 is a side elevational view partially in cross section, of one powder spray gun employed in the booth of FIG. 1.

As may be seen clearly in FIGS. 3 and 4, each gun 14 comprises a vertically oriented barrel 60 having an inlet end 62 and a discharge end 64. A nozzle 66 is fitted over the discharge end of the barrel. As is explained more fully hereinafter, the nozzle supports a conically shaped deflector suspended from the nozzle 66 of the gun. Air entrained powder is supplied to the inlet end of the gun via powder spray conduits 68. These conduits open into the inlet end of air flow amplifiers 70 secured to the inlet ends 62 of the barrels 60. Each air flow amplifier 70 has a central nozzle within which there is central nozzle within which there is a central axial bore 72 coaxially aligned with the bore of the barrel 60. Additionally, each amplifier has an annular air flow chamber 74 connected by an annular orifice 76 to the bore 72. An annular lip 78 extends inwardly to the rear of the orifice 76 and has a forwardly sloping surface 79 operable deflect air flow from the orifice in a forward direction. Compressed air is supplied to the annular chamber 74 via a bore 82 in the amplifier. This compressed air is supplied to the bore 82 from a source of air pressure 84 through a pressure regulator 86. In general, the compressed air is supplied to the amplifier 70 at a pressure on the order of 10–60 psi.

In the use of the gun 14, air entrained powder is supplied to the inlet end of the amplifier 70 via the conduit 68. It is to be noted that there is a substantial gap 87 between the end of the conduit 68 and the entrance to the amplifier 70. Ambient air is drawn through this gap into the entrance or inlet end of the amplifier 70. Compressed air is supplied to the amplifier through the bore 82 to the annular chamber 74 surrounding the bore or throat 72 of the amplifier. This compressed air then passes through the annular orifice 76 at a very high velocity and in the course of passage through the orifice 76, is deflected toward the outlet or discharge end of the gun by the lip 78 on the rearward side of the orifice 76. This high speed air is operable to impact the powder entrained air contained in the bore or throat 72 of the gun and force that powder entrained air at a greater velocity forwardly through the barrel 60 of the gun. Simultaneously, additional ambient air is pulled into the gun through the throat or gap 87 between the inlet end of the amplifier and the discharge end of the conduit 68.

In order to obtain a wide discharge pattern of powder from the gun, a conical deflector 90 is suspended from the nozzle of the gun via a stem 92, the upper end of which terminates in a cross bar 94 secured by the nozzle 66 to the discharge end of the barrel 60. The cross bar 94 is generally rectangular in configuration so that there is a large flow area through channels 96–98 located on opposite sides of the bar 94. Powder, after passing around the bar 94, exits from the gun via an orifice 100 in the nozzle 66. This powder then impacts with the diverging surface 102 of the cone shaped deflector 90 suspended from the nozzle. This deflector causes the relative high velocity powder to be dispensed over a wide area. In practice, by simply varying the pressure of air from the regulator 86 to amplifier 70, the diameter of the pattern of powder dispersed from the gun may be varied anywhere from 18–60 inches. This is a very simple technique for varying the pattern sprayed from the powder spray gun.

With reference to FIGS. 1 and 3, it will be seen that there are two powder inputs 105, 106 to the powder conduit 68. Each of these inputs 105, 106 is supplied with air entrained powder from an independently adjustable powder pump 108, 110 respectively. While it is possible to vary the quantity of powder supplied to the conduit 68 via a simple pump and to change the range of inputs by using different size and capacity powder pumps, it has been found that the use of two independently adjustable powder pumps provides a wider range of adjustability of powder inputs to the conduit 68. In some applications this wider range of variable inputs to the conduit 68 and the separate adjustability of each powder pump enables the system to accommodate varying applications which a single pump might not accommodate. Otherwise expressed, the use of two variable flow powder pumps supplying the conduit 68 facilitates the adjustment of three variables in the system; the flow of powder in pump 108, the flow of powder in pump 110, and the quantity of regulated air pressure supplied to the port 82 of the air amplifier. By adjusting these three variables, the pattern of powder and the quantity of powder dispensed onto the web by each gun may be accurately controlled.

In use of the booth 10, a continuous non-woven fiber web 16 is supplied to the booth via the conveyor 18. In one preferred embodiment, this conveyor is operable to transport the web through the the booth at a speed of 300–600 feet per minute. As the non-woven fiber web passes through the booth, air entrained powder supplied via the conduits 68 to the guns 14 is ejected from the guns at a relatively high velocity sufficient for the powder to pass through air currents associated with the relatively high speed moving web and penetrate the web. The use of the amplifier 70 in conjunction with the gun 14 enables the powder to be dispensed from the gun evenly and at a velocity which effects this penetration of the web by the powder.

After passage from the booth, the adhesive powder impregnated web is transported by the conveyor to a heating station or oven designated by the numeral 104. At this station 104 the adhesive is heated and converted to a molten or at least tacky state. The web is then passed through rollers, as is conventional in this art, so as to compress it and simultaneously lock the fibers of the web into a non-woven fabric.

In practice, I have found that the conical deflector 90 should preferably be manufactured from electrically conductive material so as to avoid a tribocharge being imparted to the powder. This tribocharge, if applied to the powder, has the effect of disturbing or varying the distribution pattern of powder emitted from the gun. If the deflector 90 is made of electrically conductive material though and is grounded, the pattern dispensed from the gun tends to be stable and not influenced by development of a tribocharge on the powder. In order to ground that deflector, the gun 14 may all be made of metal components and the barrel of the gun grounded so that the grounding lead to the deflector need not interfere with the spray pattern.

While I have described the powder spray method and apparatus of this invention, including the powder spray gun with its air flow amplifier, as being applicable to the spraying of solid powder adhesives upon non-woven fabric substrates, it will be appreciated that this method and apparatus is useful in the spraying of other powder materials, such as powdered absorbants, upon non-woven fabrics or other substrates. Particularly, this gun will find application in the spraying of powders in applications where there is a need to impart substantial velocity to the powder emitted from the gun, as for example to overcome air currents surrounding a moving substrate. Furthermore, while this gun has been described as being applicable to the spraying of powders without the application of an electrostatic charge to the powder, it will be readily apparent to persons skilled in this art that with minor modifications, this invention may be utilized in an electrostatic powder spray gun. Therefore, I do not intend to be limited except by the scope of the following appended claims.

I claim:

1. A method of spraying solid particulate powder from a powder spray gun, which gun includes a barrel and a nozzle at the discharge end of said barrel, which barrel has a central axis, which method comprises transporting said solid particulate powder to said barrel of said gun while entrained in an air stream, passing said air entrained powder through an air flow amplifier wherein said air entrained powder is impacted by a high velocity air stream directed generally parallel to the axis of said barrel and drawing ambient air into said air flow amplifier upstream of the point of impaction of said high velocity air stream with said air entrained powder material so as to increase the volume of air within which said powder material is entrained in the course of passage through said barrel, passage of said air entrained powder through said air flow amplifier being operable to increase the velocity of said solid particulate material.

2. The method of claim 1 which further comprises passing said air entrained powder over a diverging surface so as to increase the width of the pattern sprayed from said gun nozzle.

3. The method of spraying solid particulate powder from a powder spray gun, which gun includes a barrel and a nozzle at the discharge end of said barrel, which barrel has a central axis, which method comprises transporting aaid solid particulate powder to said barrel of said gun while entrained in an air stream, passing said air entrained powder axially through an air flow amplifier having a central axis extending parallel to the axis of said barrel, supplying compressed air to said air flow amplifier, impacting said air entrained powder with a high velocity stream of said compressed air directed generally parallel to the axis of said amplifier and drawing ambient air into said air flow amplifier upstream of the point of impaction of said high velocity air stream with said air entrained powder material so as to increase the volume of air within which said powder material is entrained in the course of passage through said barrel, passage of said air entrained powder through said air flow amplifier being operable to increase the velocity of said solid particulate powder in an axial direction.

4. The method of claim 3 which further comprises passing said air entrained powder over a diverging surface so as to increase the width of the pattern sprayed from said gun nozzle.

5. The method of claim 4 which further comprises varying the pressure of said compressed air in said air flow amplifier so as to vary the width of the pattern sprayed from said gun.

6. The method of varying the pattern of solid particulate powder sprayed from the nozzle of a powder spray gun, which method comprises supplying air entrained powder to the entrance throat of an air flow amplifier, supplying compressed air to said air flow amplifier, impacting said air entrained powder with a high velocity stream of said compressed air within said air flow amplifier, drawing ambient air into said air flow amplifier upstream of the point of impaction of said high velocity air stream with said air entrained powder material so as to increase the volume of air within which said powder material is entrained in the course of passage through said barrel, supplying said mixture of compressed air and air entrained powder from said air flow amplifier to said nozzle of said gun, and varying the pressure of said compressed air supplied to said air flow amplifier to vary the pattern of powder dispersed from said nozzle of said gun.

7. A powder spray gun for spraying air entrained solid particulate powder, which gun comprises a tubular barrel having an inlet end and a discharge end, means for connecting said inlet end to a source of air entrained powder, a nozzle on the discharge end of said barrel, and air flow amplifier means connected to said barrel for impacting said air entrained powder with a high velocity air stream in the course of passage of said air entrained powder through said air flow amplifier means, said air flow amplifier means having an inlet end open to ambient air and to said source of air entrained powder such that said high velocity air stream is operable to create a vacuum at said inlet end of said air flow amplifier means and draw ambient air and said air entrained powder into said air flow amplifier means.

8. The powder spray gun of claim 7 which further includes a powder dispersing deflector adjacent the discharge end of said barrel, said deflector having a diverging surface over which the air entrained powder is passed in the course of being discharged from said gun so as to establish a wide dispersion pattern of said powder.

9. The powder spray gun of claim 7 wherein said air flow amplifier means comprises an amplifier nozzle having a central bore axially aligned with said barrel, said amplifier nozzle having an inlet connected to said source of air entrained powder and an outlet open to said barrel, an annular air chamber surrounding said amplifier nozzle, an air inlet into said annular air chamber, means for connecting said air inlet to a source of compressed air, and an annular orifice connecting said annular air chamber to said bore of said amplifier nozzle.

10. The powder spray gun of claim 9 wherein said air flow amplifier means has an annular lip surrounding said annular orifice, said lip being operable to deflect air emitted from said orifice toward said discharge end of said barrel.

11. A powder spray gun for spraying air entrained solid particulate powder, which gun comprises a tubular barrel having an inlet end and a discharge end, means for connecting said inlet end to a source of air entrained powder, a nozzle on the discharge end of said barrel, and air flow amplifier means connected to said barrel, said air flow amplifier means having an inlet and being operable to draw ambient air into said inlet of said air flow amplifier means and to impact said air entrained powder with a high velocity stream of compressed air downstream of said inlet in the course of passage of said air entrained powder through said gun.

12. The powder spray gun of claim 11 which further includes a powder dispersing deflector adjacent the discharge end of said barrel of said gun, said deflector having a diverging surface over which the air entrained powder is passed in the course of being discharged from said gun so as to establish a wide dispersion pattern of said powder.

13. The powder spray gun of claim 11 which further comprises means for supplying compressed air to said air flow amplifier, and means for varying the pressure of air supplied to said air flow amplifier so as to vary the pattern of powder sprayed from said nozzle of said gun.

* * * * *